US006698593B1

(12) United States Patent
Folke et al.

(10) Patent No.: US 6,698,593 B1
(45) Date of Patent: Mar. 2, 2004

(54) VIBRATORY SCREEN SEPARATOR

(75) Inventors: Thomas Folke, Fort Thomas, KY (US); Joachim M. Zaun, Fort Thomas, KY (US); Eric K. Johnson, Edgewood, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 10/138,786

(22) Filed: May 3, 2002

(51) Int. Cl.[7] ..... B07B 1/49

(52) U.S. Cl. ..... 209/404; 209/319; 209/372; 209/405; 209/413

(58) Field of Search ..... 209/372, 404, 209/408, 413, 363, 370, 373, 399, 403, 405, 409, 412, 319

(56) References Cited

U.S. PATENT DOCUMENTS

| | | | | | |
|---|---|---|---|---|---|
| 1,991,001 | A | * | 2/1935 | Reynolds et al. | 209/237 |
| 2,959,285 | A | * | 11/1960 | Tonjes et al. | 209/319 |
| 3,439,800 | A | * | 4/1969 | Tonjes | 209/3 |
| 3,744,631 | A | * | 7/1973 | Smith et al. | 209/319 |
| 4,582,597 | A | | 4/1986 | Huber | 204/313 |
| 4,664,791 | A | * | 5/1987 | McClain et al. | 209/421 |
| 5,059,310 | A | * | 10/1991 | Fischer et al. | 209/237 |
| 5,222,605 | A | * | 6/1993 | Pogue | 209/239 |
| 5,226,546 | A | | 7/1993 | Janssens et al. | 209/319 |
| 5,232,098 | A | * | 8/1993 | St-Pierre et al. | 209/240 |
| 5,456,365 | A | | 10/1995 | Janssens et al. | 209/403 |
| 6,003,679 | A | * | 12/1999 | Maroscher et al. | 209/332 |
| 6,089,380 | A | * | 7/2000 | Hazrati et al. | 210/411 |
| 6,283,303 | B1 | * | 9/2001 | Lane et al. | 209/405 |
| 2003/0019799 | A1 | * | 1/2003 | Masukane et al. | 209/691 |

* cited by examiner

*Primary Examiner*—Donald P. Walsh
*Assistant Examiner*—Joseph C. Rodriguez
(74) *Attorney, Agent, or Firm*—Fulbright & Jaworski L.L.P.

(57) ABSTRACT

A vibratory screen separator using screens includes a base and a housing resiliently mounted to the base and divided into two wall portions held together by a clamp band. Brackets are located high on the housing and lifts are diametrically positioned to either side of the housing. The lifts are pivotally mounted to the base through feet to move from a first position engaging the brackets to a second position displaced from the housing. Each lift includes a fluid cylinder and shaft mounted to an arm. A head associated with the shaft of the fluid cylinder and shaft engages a slot on the associated bracket and can operate to lift a portion of the housing with the clamp band removed. In this lifted state, access is provided to screens clamped within the housing between housing portions.

20 Claims, 5 Drawing Sheets

VIBRATORY SCREEN SEPARATOR

BACKGROUND OF THE INVENTION

The field of the present invention is separators for screening materials using vibratory motion for enhanced screening.

Vibratory separators have long been used for the separation of materials, both wet and dry. It is common to use rectangular screen separators and circular screen separators. An example of a rectangular screen separator is illustrated in U.S. Pat. No. 4,582,597, the disclosure of which is incorporated herein by reference. A circular separator is illustrated in U.S. Pat. No. 5,226,546, the disclosure of which is incorporated herein by reference. The above-mentioned vibratory separators are provided with an inflatable and deflatable seal running around the edges of the screen frame to avoid material bypassing the screen with the inflatable seal in the inflated condition and to securely locate the screen with the separator housing.

In U.S. Pat. No. 5,226,546, the inflatable seal assists in the facile removal and replacement of screens from a circular separator without disassembly of the entire separator. Screens are subject to wear and, under certain adverse conditions, to rupture. Further, in certain applications, different mesh sizes may be required for the same machine. The quick-change aspect of this device, therefore, provides substantial operational advantage. However, not all applications are best suited for use of an inflatable mechanism or seal.

In U.S. Pat. No. 5,456,365, the disclosure of which is incorporated herein by reference, a vibratory screen separator using a resiliently mounted housing has a first wall portion having an upper edge and a second wall portion above the first wall portion having a lower edge. The upper and lower edges may be mutually aligned to define a seat therebetween to receive a screen. The upper and lower edges further include flanges which extend radially outwardly of the housing to receive a clamp band for securely assembling the wall portions. Mounts coupled to the first and second wall portions have a first position with the upper and lower edges of the housing gripping the screen and a second position with the upper and lower edges of the housing mutually displaced from the screen. In the latter position, the screen is released and can be easily accessed for removal and replacement.

The device disclosed in U.S. Pat. No. 5,456,365 includes the mounts on the wall portions of the housing. Thus, they are vibrated with the equipment. The equipment is subject to substantial lateral displacement when passing through natural resonance to or from working speeds. Even though these mounts must be driven with the separator housing, increasing the weight thereof, they don't experience the problem of being stationary equipment adjacent to the separator when the separator housing is passing through natural resonance. Further, they don't increase the footprint of the system.

SUMMARY OF THE INVENTION

The present invention is directed to a vibratory separator using screens. The separator includes a base and a housing resiliently mounted to the base. The housing is divided into wall portions which fit together with the screens positionable within the housing between the wall portions. A clamp assembly fixes the portions together. A lift system pivotally mounted relative to the base cooperates with one or more brackets on the upper portion of the separator to allow a raising of one portion of the housing relative to another to provide access therebetween for the insertion and removal of screens. A lift of the system includes an arm, an extension device mounted on the arm and a head mounted on the fluid cylinder and shaft. The head is engageable with a bracket when the arm is pivoted into a first, engaging position.

In the foregoing combination, the housing portions may be conventionally formed with outwardly extending flanges defining seating for the screen therebetween. The assembly of the wall portions may then be conventionally secured by the clamp assembly such as a clamp band.

The foregoing combination may employ two such lifts diametrically positioned of the housing. Each lift may further include a foot fixed relative to the base of the vibratory separator to pivotally mount the arm.

Accordingly, it is an object of the present invention to provide an improved vibratory screen separator and system for facilely accessing screen mounting areas between housing portions. Other and further objects and advantages will appear hereinafter.

DETAILED DESCRIPTION OF THE PREFERRED EMBODIMENT

Figure 1:
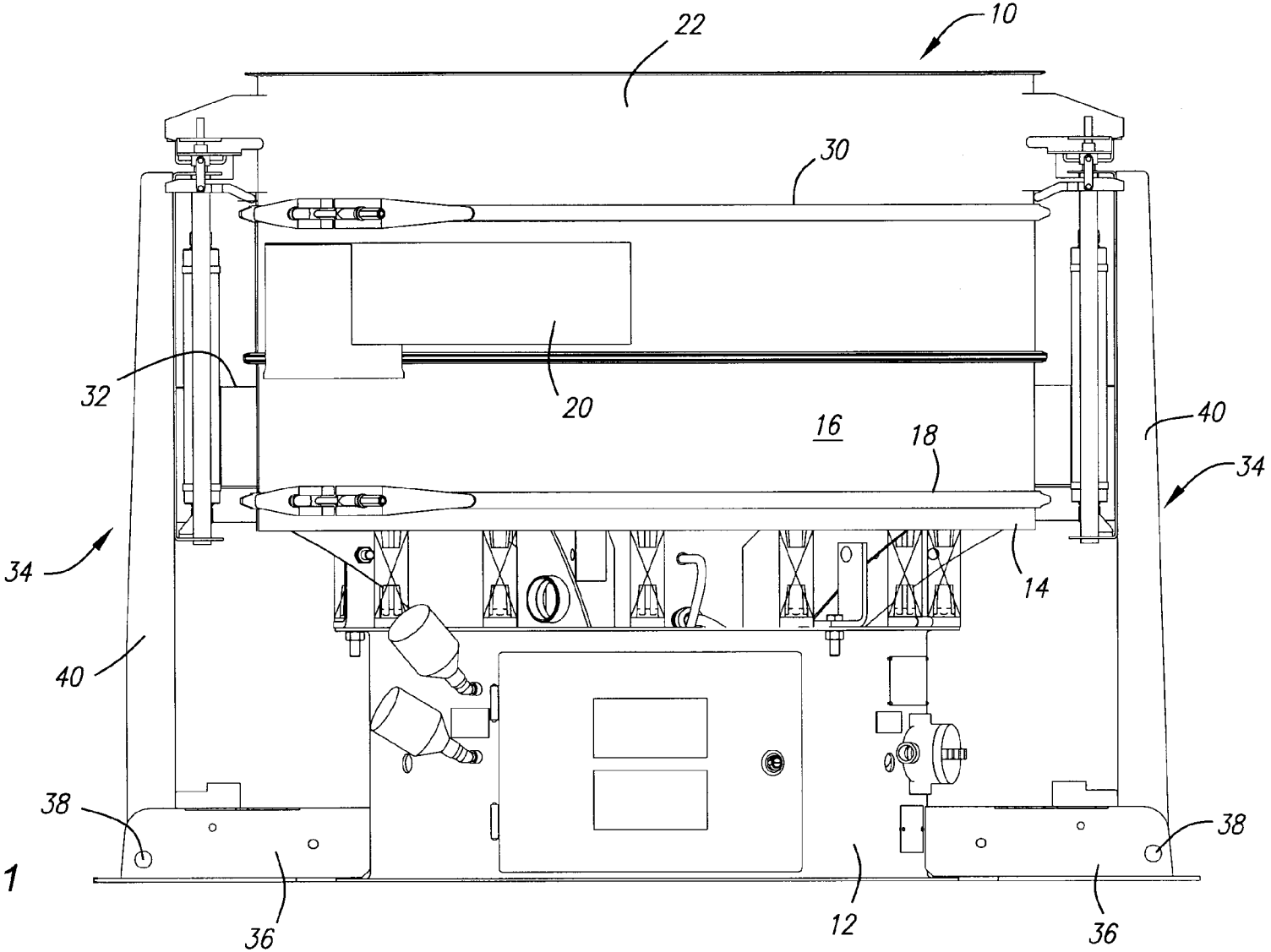
FIG. 1 is a side view of a vibratory screen separator with two housing portions.

Turning in detail to the Figures, the illustrated preferred embodiment employs a circular vibratory screen separator. This separator includes a housing, generally designated 10, which is an assembly of cylindrical components. By means of resilient members, e.g., springs, which are not shown in the drawings, the separator housing 10 is mounted to a base 12 in a conventional manner. A vibratory generator, also of conventional design and not illustrated, is securely mounted within the lower table 14 of the housing 10.

Figure 2:
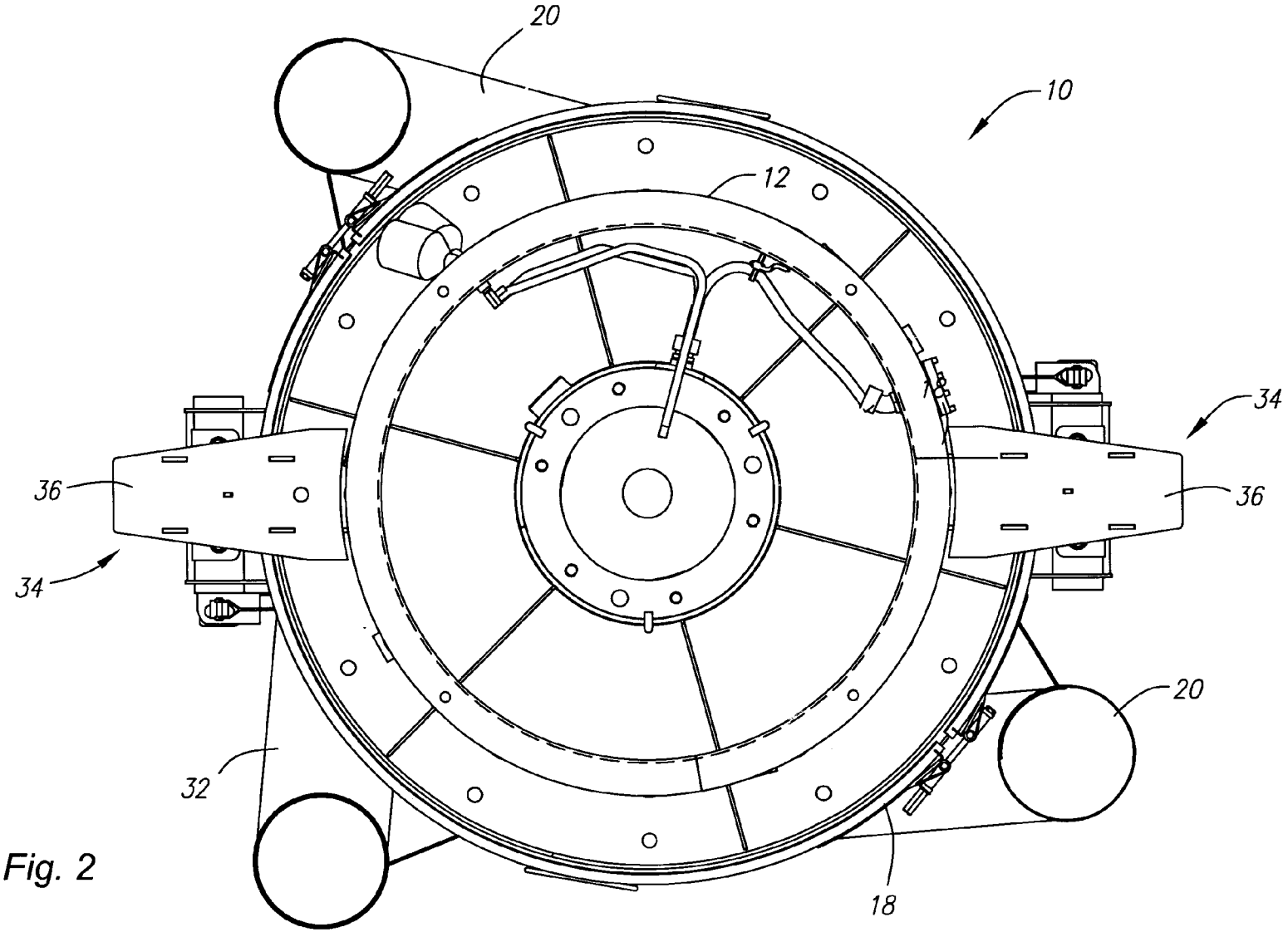
FIG. 2 is a bottom view of the vibratory screen separator illustrated in FIG. 1.

A lower cylindrical wall portion 16 of the housing 10 is mounted to the table 14. Conventionally, the table 14 includes an outwardly extending flange. The lower wall portion 16 also includes an outwardly extending flange on its lower edge. These flanges are brought together and securely clamped by a conventional clamp band 18 as illustrated in FIG. 1. A dome 19 is typically welded in place within the lower housing 16 with a discharge port 20 located through the sidewall of the portion 16 to receive screened material from the upper surface of the dome. A second such discharge port 20 is shown in the bottom view of FIG. 2 to be located diametrically around the lower wall portion 16 from the first discharge port 20.

An upper cylindrical wall portion 22 is aligned with the lower cylindrical wall portion 16. The lower portion 16 includes an upper edge defining an outwardly extending flange 24. The upper wall portion 22 includes a lower edge defining an outwardly extending flange 26. These flanges 24 and 26 are mutually aligned and define a seat therebetween for holding a screen 28. Such screens 28 are typically comprised of a screen frame across which a screen cloth is drawn taut. A gasket 29 may be conventionally placed around the frame to enhance the seal against the flanges 24 and 26. Reference is again made to U.S. Pat. No. 5,456,365. A clamp band 30 defines a clamp assembly between the upper portion 22 and the lower portion 24. A discharge port 32 is positioned through the wall of the upper wall portion 22 to receive the material unable to pass through the screen 28 from the top of the screen positioned within the housing between the upper wall portion 22 and the lower wall portion 24.

The housing 10 may include further upper cylindrical wall portions 22 stacked one on top of another in the same manner with associated clamp assemblies 30. These additional upper cylindrical wall portions 22 would support additional screens 28 at their intersections. Additionally, the housing may include a top (not shown). A top would typically not include a screen mounting position but would include a flange to cooperate with the upper most upper cylindrical wall portion 22 to receive a clamp band 30.

Figure 3:
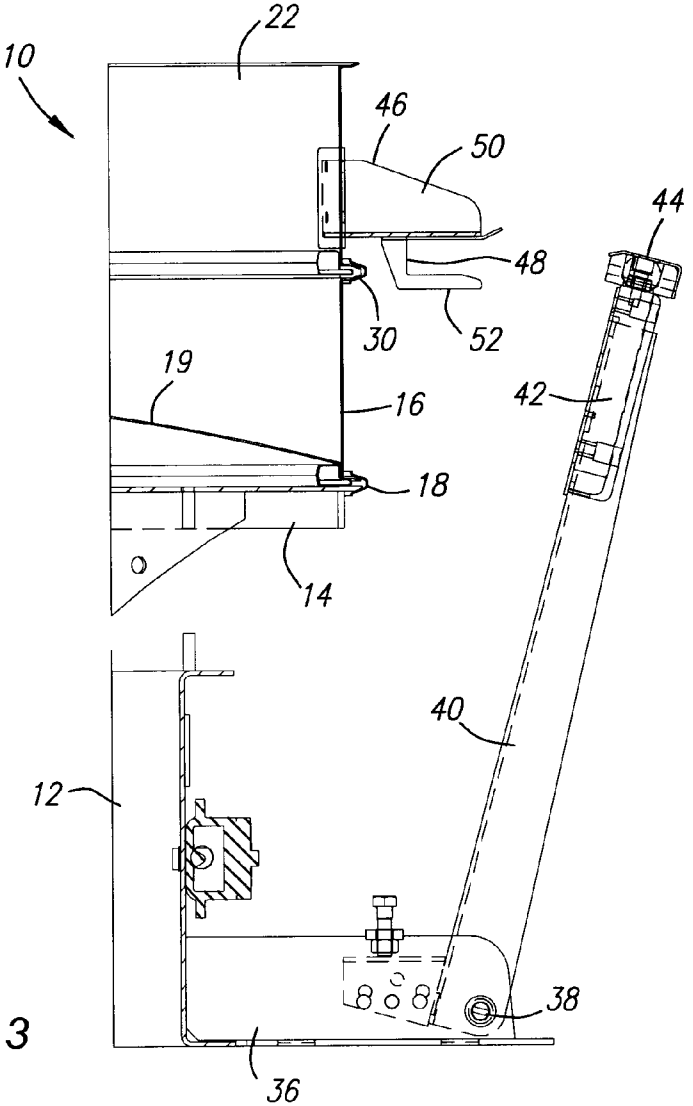
FIG. 3 is a partial side view of the vibratory screen separator of FIG. 1 with a lift illustrated in a displaced position.

A lift system in the preferred embodiment is illustrated to include two lifts, generally designated 34 which are illustrated as being diametrically positioned about the housing 10. Each lift includes a foot 36 extending radially outwardly from the base 12 and may be attached or attachable to the base 12. Each foot 36 includes a pivot mount 38 near its distal end. An arm 40 extends upwardly from each foot 36 and is pivotally mounted at the mount 38. Pivoting of the arm 40 is limited as can be seen in FIG. 3 to avoid becoming a nuisance and extending into other work space. At the same time, the arms 40 fall within the same shipping footprint as the separator with the arms 40 pivoted inwardly. The arms 40 are to pivot outwardly such that contact with the housing is avoided even under the substantial lateral displacement experienced when the separator housing 10 is passing through natural resonance.

An extension device is associated with the upper, free end of the arm 40. The extension device may be a fluid cylinder and shaft, either hydraulic or pneumatic, a mechanical jackscrew having an upwardly extending shaft, or the like. The shaft of the extension device extends upwardly from the cylinder to mount a head 44. In the preferred embodiment, the cylinder and shaft 42 is hydraulic.

Figure 4:
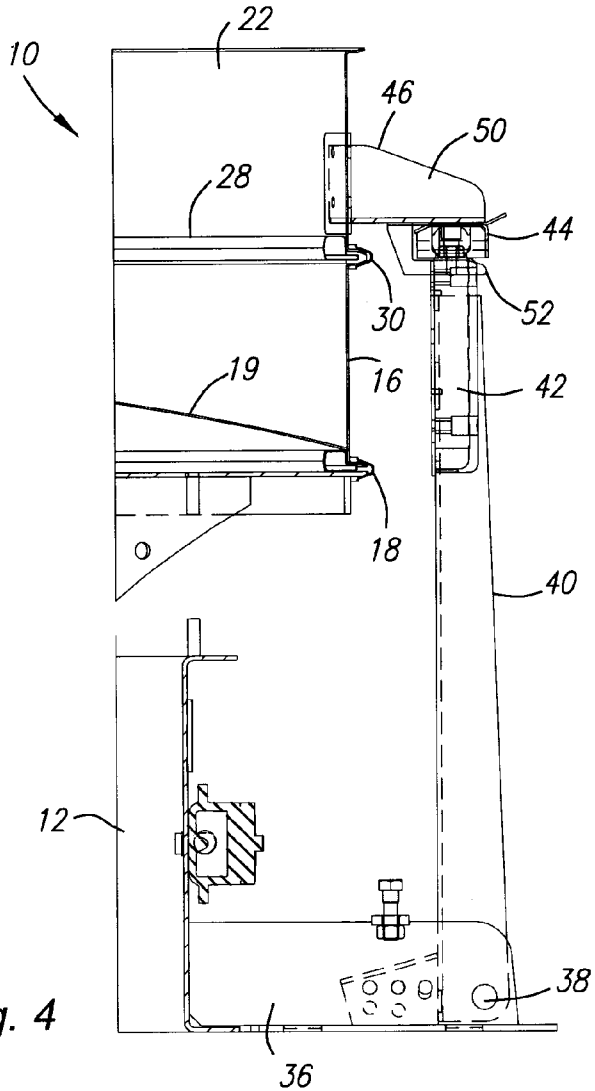
FIG. 4 is a partial side view of the vibratory screen separator of FIG. 1 with a lift illustrated in a engaged position.
Figure 5:
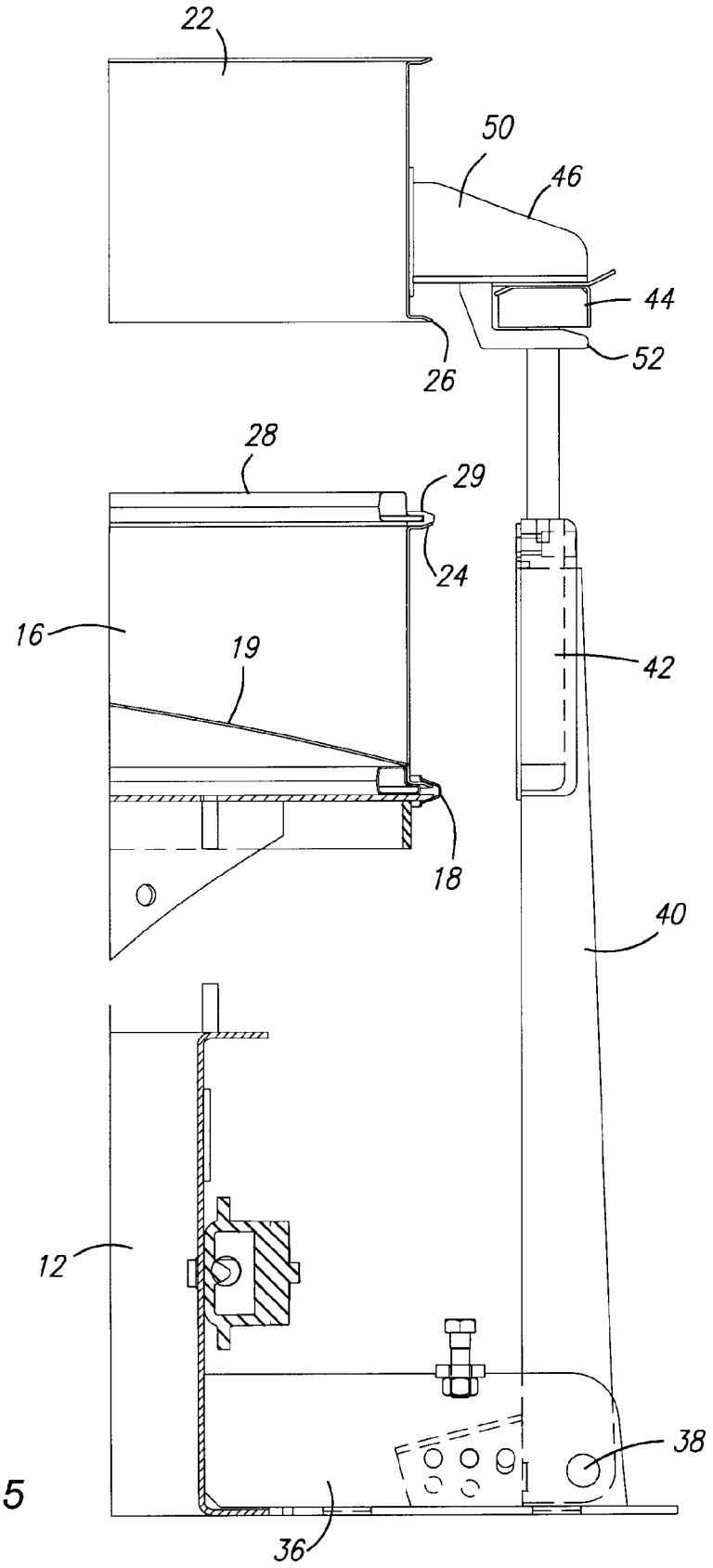
FIG. 5 is a partial side view of the vibratory screen separator of FIG. 1 with a lift illustrated in a engaged position with the upper housing portion displaced from the lower housing portion.

FIGS. 3 and 4 illustrate the two extreme working positions of the arm 40 of the lift 34. In FIG. 4, the arm 40 is in an engaged position while in FIG. 3, the arm 40 is in a displaced position with the lift 34 displaced away from the housing. FIGS. 3 and 4 also illustrate a first state of the fluid cylinder and shaft 42 with the head 44 in a retracted position. FIG. 5 illustrates a second state of the fluid cylinder and shaft 42 with the head 44 extended away from the arm 40.

Two brackets 46 are located above the lower flange 26 and more specifically are located on the side of the upper wall portion 22. The brackets 46 each include a slot 48 into which the head 44 can seat. The slot is defined by an upper mount 50 and a lower fork 52. The fork 52 provides access for the shaft of the cylinder and shaft mechanism 42. The head 44 is of significant size and is closely received within the slot 48 to stabilize the lifted components from pivoting about an axis extending through the two heads 44.

Figure 6:
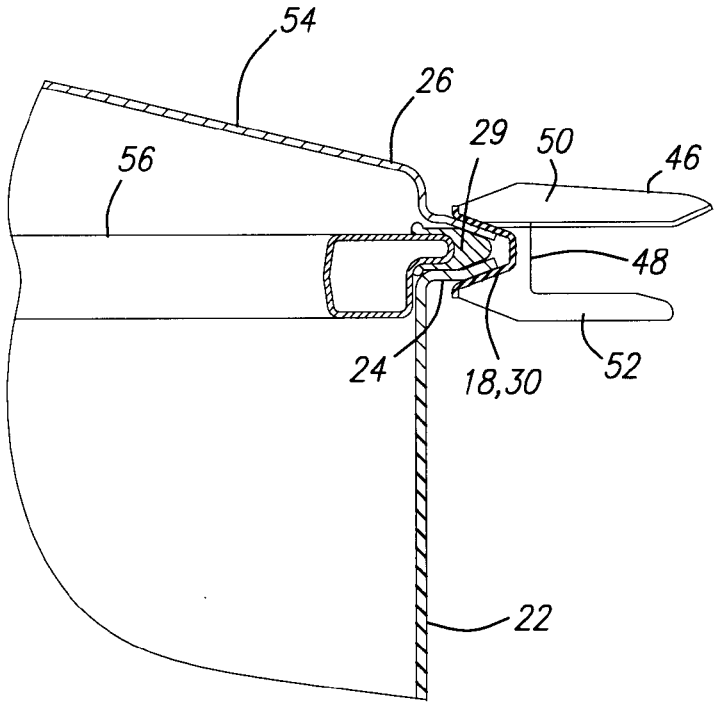
FIG. 6 is a cross-sectional detail of a bracket fixed to a clamp band.
Figure 7:
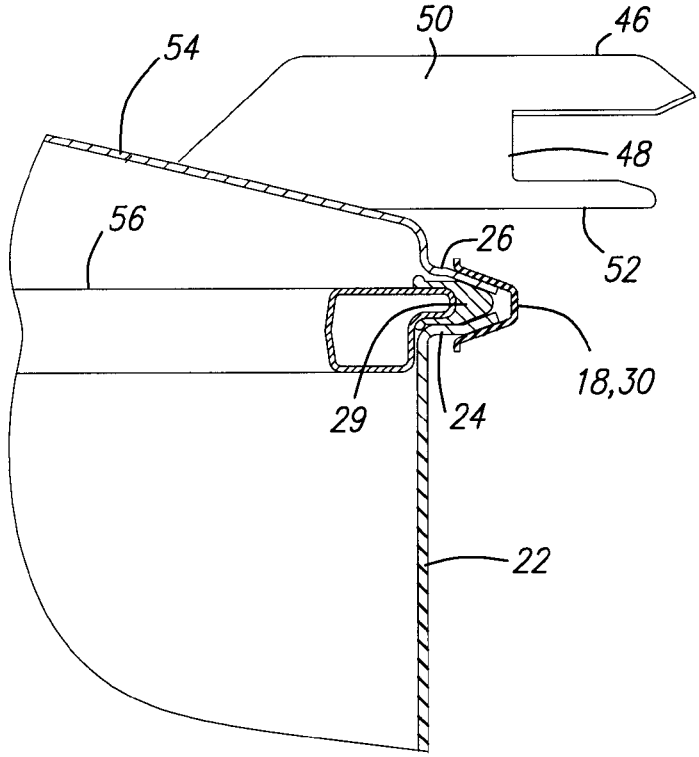
FIG. 7 is a cross-sectional detail of a bracket fixed to a cover for the housing.

Alternatively to mounting the brackets 46 to the uppermost cylindrical wall portion 22, the bracket 46 may be mounted to one of the clamp bands 30 as illustrated in FIG. 6 through welding or other means or to a cover 54 as illustrated in FIG. 7. It may be noted that the screen frame 56 used at the cover is often a dummy without a screen cloth attached such that all components of the housing are flexible in their assembly.

In operation, the vibratory screen separator is used with the arms 40 of the lifts 34 canted outwardly as seen in FIG. 3. When a screen 28 is to be replaced, the arms 40 are manually pivoted inwardly to engage the heads 44 within the slots 48. This orientation is illustrated in FIG. 4. The clamp band 30 is then removed to release the upper cylindrical wall portion 22 from the lower cylindrical wall portion 16. Once released, the fluid cylinder and shaft 42 can be actuated through the use of hydraulic pressure to raise the heads 44 and in turn the upper cylindrical wall portion 22. With the upper cylindrical wall portion 22 and the lower cylindrical wall portion 16 mutually displaced, access is provided to the screen 28 for its facile removal and replacement. Once replaced, the hydraulic pressure is removed and the upper wall portion 22 is again lowered into place. The clamp band 30 is replaced and tightened. The arms 40 are then canted outwardly again and the system is ready for further operation.

The embodiment and operation illustrated shows servicing of one screen deck. Devices having multiple screens may employ the same system by simply selecting which clamp band is removed if the brackets 46 are on the uppermost component of the housing 10. In the present embodiment, the lower clamp band 18 may be removed to raise the entire cylindrical wall assembly of the housing 10 from the table 14. The entire housing could also be lifted to service the springs, the motor or other components. Where appropriate, the brackets 46 may be associated with a top rather than with a sidewall. In that circumstance, a clamp band could be employed between the cylindrical housing wall and the top. Again, a choice can be made as to the components accessed by selecting the appropriate clamp band to be removed.

Thus, an improved vibratory screening system has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A vibratory screen separator using screens, comprising a base;

a housing resiliently mounted to the base and including a first wall portion having an upper edge and at least a second wall portion positionable above said first wall portion and having a lower edge, the upper and lower edges being mutually alignable with one of the screens positioned within the housing between the first wall portion and the second wall portion;

a clamp assembly extendable between the first wall portion and second wall portion to fix together the first and second wall portions;

at least one bracket on one of the housing and the clamp assembly;

a lift system including an arm pivotally mounted relative to the base, an extension device mounted on the arm, a head mounted on the extension device to extend toward and away from the arm with actuation of the extension device, a first position with the head engaging one of the at least one brackets and a second position with the arm displaced away from the housing and the said bracket, the extension device with the arm in the first position having a range of extension from a first state with the upper and lower edges together to a second state with the upper and lower edges mutually displaced to provide access therebetween to insert one of the screens into the housing between the first wall portion and the second wall portion.

2. The vibratory screen separator of claim 1, the upper and lower edges defining a seat therebetween to receive a screen frame.

3. The vibratory screen separator of claim 2, the first and second wall portions being circular and the upper and lower edges, respectively, having outwardly extending flanges, the clamp assembly being a clamp band positionable over the outwardly extending flanges.

4. The vibratory screen separator of claim 1, the said bracket including a slot into which the head can seat.

5. The vibratory screen separator of claim 1, the extension device being a fluid cylinder and shaft.

6. The vibratory screen separator of claim 5, the fluid cylinder and shaft being hydraulic.

7. The vibratory screen separator of claim 1, the at least one bracket being mounted to the upper most second wall portion.

8. The vibratory screen separator of claim 1, there being two said arms, extension devices and heads with each set being diametrically positioned of the housing, and two said brackets receiving the sets, respectively.

9. The vibratory screen separator of claim 8, each set further including a foot fixed to the base and extending radially outwardly from the base with the arm being pivotally mounted to the foot.

10. The vibratory screen separator of claim 1, the bracket being mounted to the clamp assembly.

11. The vibratory screen separator of claim 1, the housing further including a cover, the bracket being mounted to the cover.

12. A vibratory screen separator using screens, comprising a base;

a housing resiliently mounted to the base and including a first wall portion having an upper edge and a second wall portion positionable above said first wall portion and having a lower edge, the upper and lower edges being mutually alignable with one of the screens positioned within the housing between the first wall portion and the second wall portion;

a clamp assembly extendable between the first wall portion and second wall portion to fix together the first and second wall portions;

brackets on the housing above the lower edge;

lifts, each lift including an arm pivotally mounted relative to the base, a fluid cylinder and shaft mounted on the arm, a head mounted on the fluid cylinder and shaft to extend toward and away from the arm with actuation of the fluid cylinder and shaft, a first position with the head engaging one of the brackets and a second position with the lift displaced away from the housing and the said bracket, the fluid cylinder and shaft with the lift in the first position having a range of extension from a first state with the upper and lower edges together to a second state with the upper and lower edges mutually displaced to provide access therebetween to insert one of the screens into the housing between the first wall portion and the second wall portion.

13. The vibratory screen separator of claim 12, the upper and lower edges defining a seat therebetween to receive a screen frame.

14. The vibratory screen separator of claim 13, the first and second wall portions being circular and the upper and lower edges, respectively, having outwardly extending flanges, the clamp assembly being a clamp band positionable over the outwardly extending flanges.

15. The vibratory screen separator of claim 12, the brackets including slots into which the heads can seat.

16. The vibratory screen separator of claim 12, the fluid cylinder and shaft being hydraulic.

17. The vibratory screen separator of claim 12, the brackets being mounted to the second wall portion.

18. The vibratory screen separator of claim 12, there being two said lifts diametrically positioned of the housing.

19. The vibratory screen separator of claim 12, each of the lifts further including a foot fixed to the base and extending radially outwardly from the base, the arm being pivotally mounted to the foot.

20. A vibratory screen separator using screens, comprising a base;

a housing resiliently mounted to the base and including a first circular wall portion having an upper edge and a second circular wall portion positionable above said first wall portion and having a lower edge, the upper and lower edges being mutually alignable with one of the screens positioned within the housing between the first wall portion and the second wall portion, the upper and lower edges having outwardly extending flanges defining a seat therebetween to receive a screen frame;

a clamp band extendable between the first wall portion and second wall portion over the outwardly extending flanges to fix together the first and second wall portions;

brackets on the housing above the lower edge;

two lifts diametrically positioned of the housing, each lift including a foot fixed to the base and extending radially outwardly from the base, an arm pivotally mounted to the foot, a fluid cylinder and shaft mounted on the arm, a head mounted on the fluid cylinder and shaft to extend toward and away from the arm with actuation of the fluid cylinder and shaft, a first position with the head engaging one of the brackets and a second position with the lift displaced away from the housing and the said bracket, the fluid cylinder and shaft with the lift in the first position having a range of extension from a first state with the upper and lower edges together to a second state with the upper and lower edges mutually displaced to provide access therebetween to insert one of the screens into the housing between the first wall portion and the second wall portion.

* * * * *